US008099868B1

(12) United States Patent
Votolato

(10) Patent No.: US 8,099,868 B1
(45) Date of Patent: Jan. 24, 2012

(54) DISPOSABLE BLADE CARTRIDGE UTILITY KNIFE

(75) Inventor: Earl Votolato, Newport Beach, CA (US)

(73) Assignee: Votolato Living Trust, Newport Beach, CA (US)

( * ) Notice: Subject to any disclaimer, the term of this patent is extended or adjusted under 35 U.S.C. 154(b) by 0 days.

(21) Appl. No.: 12/319,677

(22) Filed: Jan. 9, 2009

Related U.S. Application Data

(63) Continuation-in-part of application No. 10/818,661, filed on Apr. 5, 2004, now Pat. No. 7,475,480.

(51) Int. Cl.
*B26B 3/08* (2006.01)

(52) U.S. Cl. ..... 30/2; 30/294; 30/337

(58) Field of Classification Search ..... 30/2, 151, 30/286, 289, 293, 294, 317, 51, 58, 77, 79, 30/527, 532, 535, 292, 125, 329, 337, 338, 30/55, 162, 260, 364; 24/615, 616, 630, 24/625; 16/422, 114 R
See application file for complete search history.

(56) References Cited

U.S. PATENT DOCUMENTS

| | | | | | |
|---|---|---|---|---|---|
| 365,714 | A | | 6/1887 | Warner | |
| 1,577,880 | A | * | 3/1926 | Stuart | 279/93 |
| 2,209,751 | A | | 7/1940 | Wulff | |
| 2,376,887 | A | | 5/1945 | Walters | |
| 2,531,736 | A | | 11/1950 | Lynch | |
| 2,624,936 | A | | 1/1953 | Jensen | |
| 2,695,447 | A | | 11/1954 | Maynard | |
| 2,730,800 | A | | 1/1956 | Bailey | |
| 2,743,523 | A | | 5/1956 | Honey | |
| 3,004,337 | A | | 10/1961 | Schweizer | |
| 3,430,339 | A | | 3/1969 | Hobson | |
| 3,657,811 | A | | 4/1972 | Nissen et al. | |
| 3,781,988 | A | | 1/1974 | Jones | |
| 4,028,802 | A | | 6/1977 | Houghton et al. | |
| 4,531,286 | A | | 7/1985 | Vito et al. | |
| 4,675,996 | A | | 6/1987 | DuBuque | |
| 4,794,692 | A | * | 1/1989 | Wang | 30/123 |
| D304,154 | S | * | 10/1989 | Osterhout | D8/99 |
| 4,980,977 | A | | 1/1991 | Matin et al. | |
| 5,095,621 | A | | 3/1992 | Rapp | |
| 5,234,436 | A | | 8/1993 | Eaton et al. | |
| 5,241,750 | A | | 9/1993 | Chomiak | |
| 5,342,379 | A | | 8/1994 | Volinsky | |
| 5,366,445 | A | | 11/1994 | Haber et al. | |
| 5,379,496 | A | * | 1/1995 | Krauss | 24/625 |
| D355,345 | S | * | 2/1995 | Drust | D8/99 |
| 5,497,553 | A | * | 3/1996 | Chong | 30/162 |
| 5,522,135 | A | | 6/1996 | Votolato | |
| 5,570,700 | A | | 11/1996 | Vogeler | |
| 5,697,157 | A | | 12/1997 | Votolato | |
| 5,765,289 | A | | 6/1998 | Schulz et al. | |
| D399,720 | S | * | 10/1998 | Owens et al. | D8/98 |
| 5,846,181 | A | | 12/1998 | Heckele et al. | |
| 5,890,296 | A | | 4/1999 | Metcalf et al. | |
| D411,429 | S | * | 6/1999 | Gringer | D8/95 |
| D413,247 | S | * | 8/1999 | Schmidt | D8/99 |

(Continued)

*Primary Examiner* — Laura M. Lee
(74) *Attorney, Agent, or Firm* — Fish & Associates, PC

(57) ABSTRACT

A utility knife having a disposable blade cartridge is presented. The cartridge can include a stem having catches, where the stem can be inserted into an opening of the knife's handle. The cartridge can be releasably attached to the handle by allowing the catches to latch on to a shoulder portion of an opening in the handle. The opening can be defined by the shoulder and a rib that separates the opening from a neighboring opening.

7 Claims, 9 Drawing Sheets

U.S. PATENT DOCUMENTS

| | | | | |
|---|---|---|---|---|
| 5,933,918 | A | 8/1999 | Wallays | |
| D433,914 | S * | 11/2000 | Chu | D8/99 |
| 6,209,729 | B1 * | 4/2001 | Brouillard | 210/470 |
| 6,237,974 | B1 * | 5/2001 | Chisholm | 294/55 |
| 6,276,063 | B1 * | 8/2001 | Chen | 30/161 |
| 6,468,279 | B1 | 10/2002 | Reo | |
| 6,544,277 | B1 | 4/2003 | O'Heeron et al. | |
| 6,560,873 | B1 | 5/2003 | Ortner et al. | |
| D476,214 | S * | 6/2003 | Hsu | D8/99 |
| 6,637,112 | B2 * | 10/2003 | Davis | 30/2 |
| 6,718,640 | B1 | 4/2004 | John | |
| 6,928,738 | B2 | 8/2005 | Segrea | |
| 2007/0272061 | A1 * | 11/2007 | Hsieh | 81/177.85 |

* cited by examiner

FIG. 19.
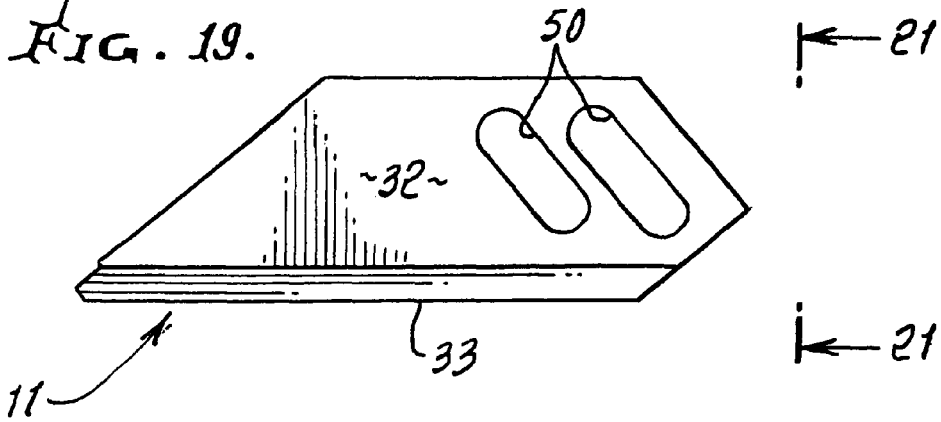
FIG. 20.
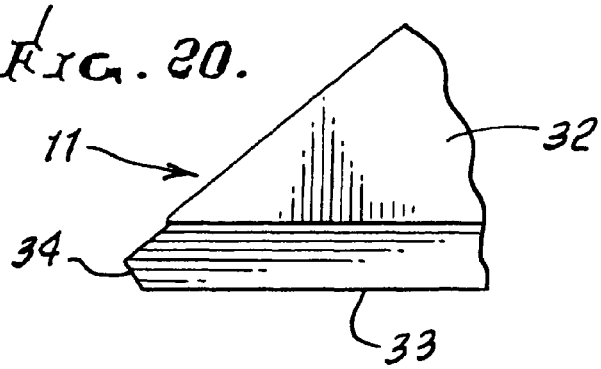
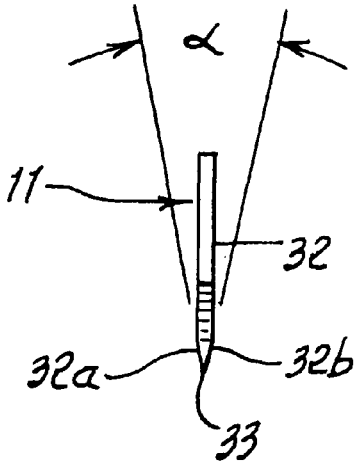
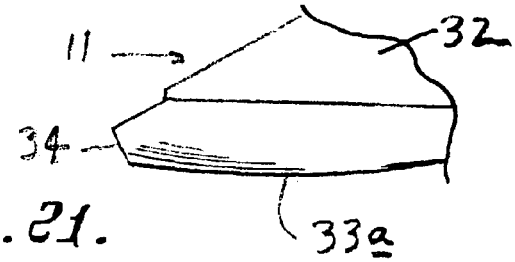
FIG. 21.
FIG. 22.

DISPOSABLE BLADE CARTRIDGE UTILITY KNIFE

This application is a continuation-in-part of U.S. application Ser. No. 10/818,661, filed Apr. 5, 2004, now U.S. Pat. No. 7,475,480.

BACKGROUND OF THE INVENTION

This invention relates generally to cutting and/or slitting devices, as are used for opening boxes or cutting cardboard, and more particularly, to an improved device of simple, compact, heavy duty lightweight construction and enabling its throw-away disposal.

Most utility knives are such that they require raw loose blades to be changed out when the blade dulls. This results in the "dulled" blades ending up everywhere and contaminating everything from food to chemical batches to textile and clothing. The raw blades also are a safety hazard even when disposed of in a trash receptacle due to someone having the job of rummaging through the trash looking for something they should not have thrown out.

There is need for an improved utility knife that minimizes, if not eliminates such issues of safety and contamination.

There is need for devices, as referred to above, and in particular, there is need for very low cost such devices which are made to be disposed of without danger, themselves or their components. The device disclosed herein improves over those of U.S. Pat. Nos. 5,522,135 and 5,697,157 incorporated herein by reference.

SUMMARY OF THE INVENTION

It is a major object to provide an improved knife or cutter or slitting device of simple, low cost, compact, simple component construction, and which is safe to use, and safe when disposed of by virtue of blade protection. Basically, the preferred device comprises:

a) a cartridge, b) a blade carried by the cartridge, c) a holder supporting the cartridge so that the blade projects from the holder, d) a shield for the blade, carried to be displaced relative to the holder and blade to expose the blade, for cutting.

As will appear, the location of the blade on the cartridge is made for throw away, or replacement compatibility as respects the holder. In this regard, the shield is easily attached to the cartridge to enable its protection of the blade when disposed of. In this regard, the shield is typically pivotable relative to the cartridge and blade, onto which the shield is easily installed.

Another object is to provide the cartridge to be received by the holder to be removable and replaceable. When a replacement cartridge is then installed in or on the handle portion of the holder, the blade is in operating position, projecting endwise from the handle portion of the holder.

Yet another object is to provide a detent connection holding the cartridge elongated portion to the elongated handle portion of the holder. That connection may include an easily operated push-in disconnection.

A further object is to provide handle portion ribs which extend generally transversely relative to handle portion length, and provide for positive gripping.

Additional objectives include provision of an improved knife or cutter, embodying one or more of the above features, and further characterized by:

1. Disposable blade cartridge,
2. Disposable blade cartridge with an automatically retractable protective blade guard or shield to assist in making the cartridge safe to handle when off and on the knife handle, including the time after which the cartridge is disposed of.
3. Cartridges can be color coded to provide for an easy identifier to the cartridge's use-special blade, cutting depth, special applications, etc.
4. Light-weight molded construction—inexpensive to produce—high impact plastic/polymer construction with the exception of the blade.
5. The handle can be made of plastic or metal.

These and other objects and advantages of the invention, as well as the details of an illustrative embodiment, will be more fully understood from the following specification and drawings, in which:

DRAWING DESCRIPTION

FIG. 19 is an enlarged side elevation showing the cartridge blade;

FIG. 20 is an enlarged fragmentary view showing blade forward edge configuration; and FIG. 21 is an edge view taken on lines 21-21 of FIG. 19.

FIG. 22 shows a modification.

DETAILED DESCRIPTION

In the example, the knife 100 includes:

a) a cartridge, one example being shown at 10;

b) a blade carried by the cartridge body, one example of such a blade indicated at 11;

c) a holder supporting the cartridge so that the blade projects at 11*a* from the cartridge, one example of such a holder being indicated at 12; and d) a shield for the blade, carried to be displaced relative to the holder to controllably expose the blade for cutting, one example of such a shield being shown at 13.

It will be understood that other forms of such elements 10-13 may be provided.

Figure 15:
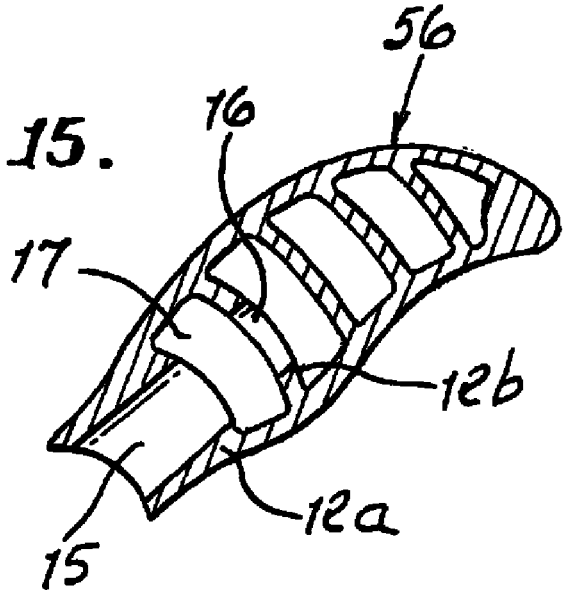
FIG. 15 is a section taken on lines 15-15 of FIG. 14, showing interior construction of a handle section, and a guide for cartridge insertion.
Figure 16:
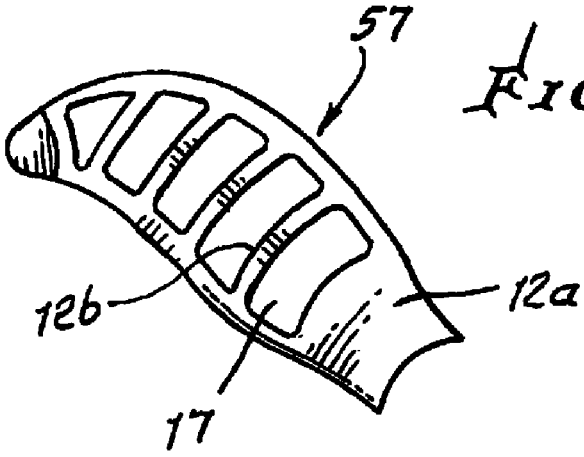
FIG. 16 is an elevation taken on lines 16-16 of FIG. 14.
Figure 17:
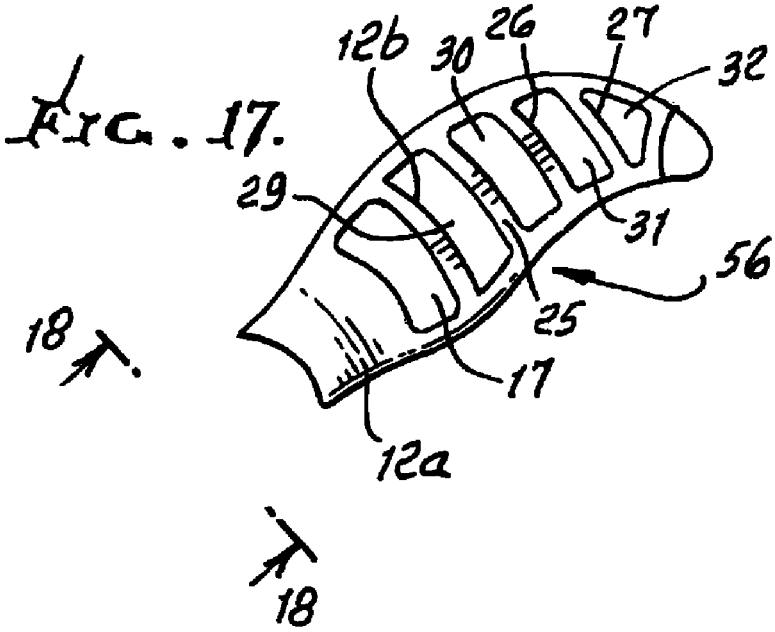
FIG. 17 is an elevation taken on lines 17-17 of FIG. 14.
Figure 18:
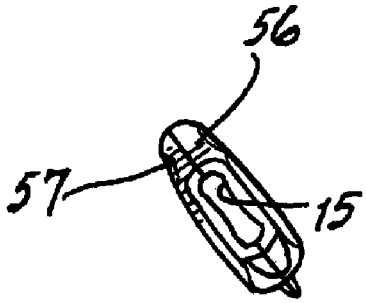
FIG. 18 is an end view taken on lines 18-18 of FIG. 17.

The illustrated cartridge 10 is configured to be receivable by the holder in such manner that it can be readily removable and replaced, thereby to enable blade replacement. The cartridge typically defines a blade carrying body portion 10*a* and a stem 14, shown in FIGS. 1, 3, 4 and 6-10. That stem is insertable endwise into the holder or handle 12 as via guide passages or slots 15 and 16 in holder portions 12*a* and 12*b*. See FIG. 15. The latter portion 12*a* and 12*b* are spaced apart endwise of the holder as shown to expose a sideward through opening 17 via which manual release of the cartridge is enabled. See for example the detents or catches 20 and 21 on spring arms 20*a* and 21*a* carried by the stem to be respectively exposed or presented at opposite sides of the holder via side through opening 17. When manually pushed or pinched oppositely inwardly, the catches release from engagement with shoulder 23 on the holder portion 12*a* to allow endwise slide-out removal of the cartridge stem from the holder. The latter may project at 12*c* in the form of a curved handle to be readily grasped by the user. Note the cross-pieces or transverse "bridges" 25-28 defined by the handle, with sideward through openings 29-32 therebetween, facilitating firm manual grasping at bridge edges during use, and without hand slippage. The handle includes opposed like sections 56 and 57 which are suitably attached together. See FIGS. 14-17.

The metallic blade 11 may be integral with (for example molded to) the cartridge body portion 10*a* to project endwise. See FIG. 7, and See FIG. 19 showing openings 50 in the blade to receive plastic material of body portion 10*a*. As shown in FIGS. 19-21, the blade has a thin body 32, and an elongated cutting edge 33 formed by V-shaped intersection of opposite sides 32*a* and 32*b* of the body. The V-shaped angle $\alpha$ is formed by the sides, as seen in FIG. 21. Note bevel 34 at the forward end of edge 33.

Figure 1:
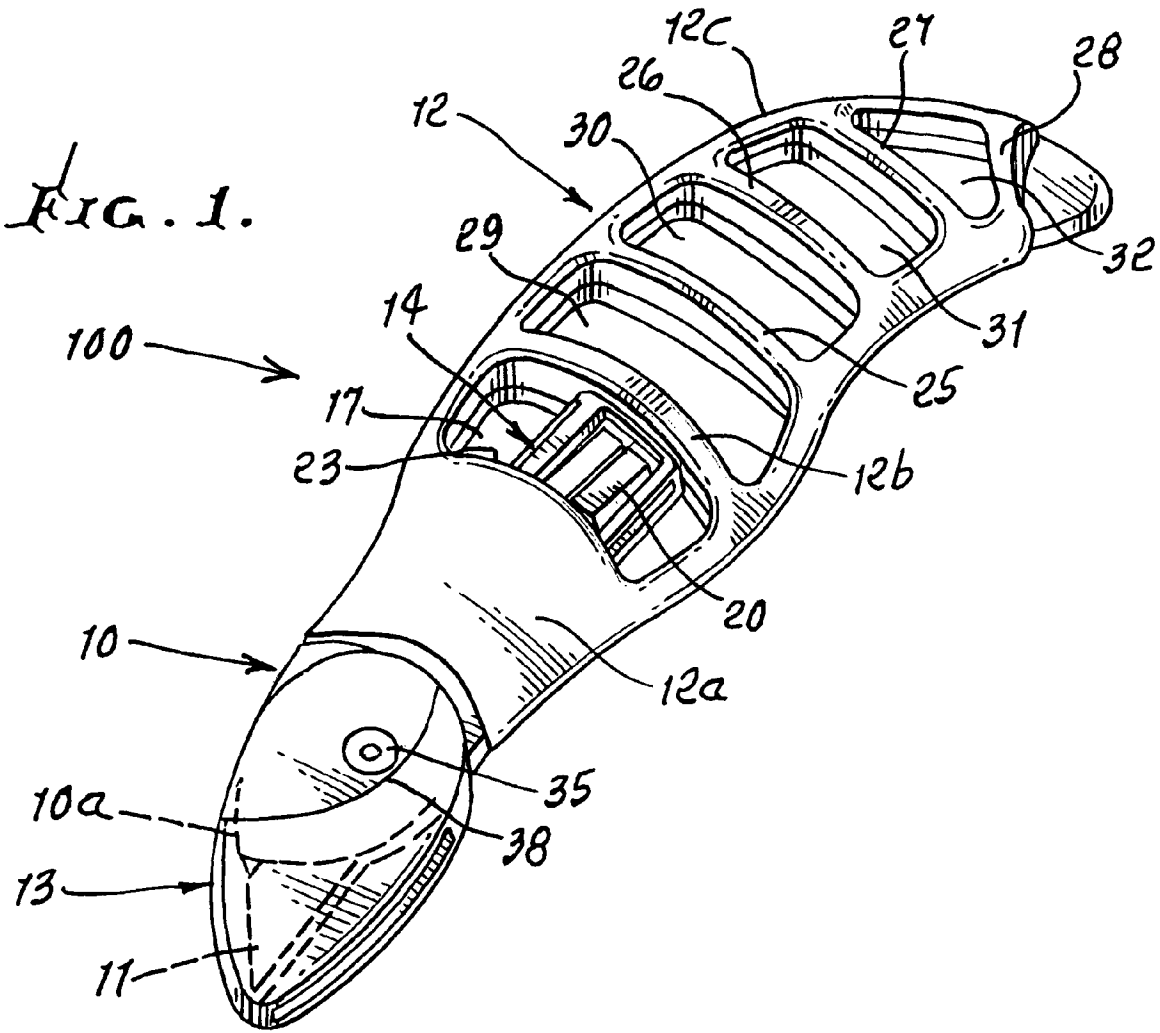
FIG. 1 is a perspective view of a knife embodying the invention.
Figure 2:
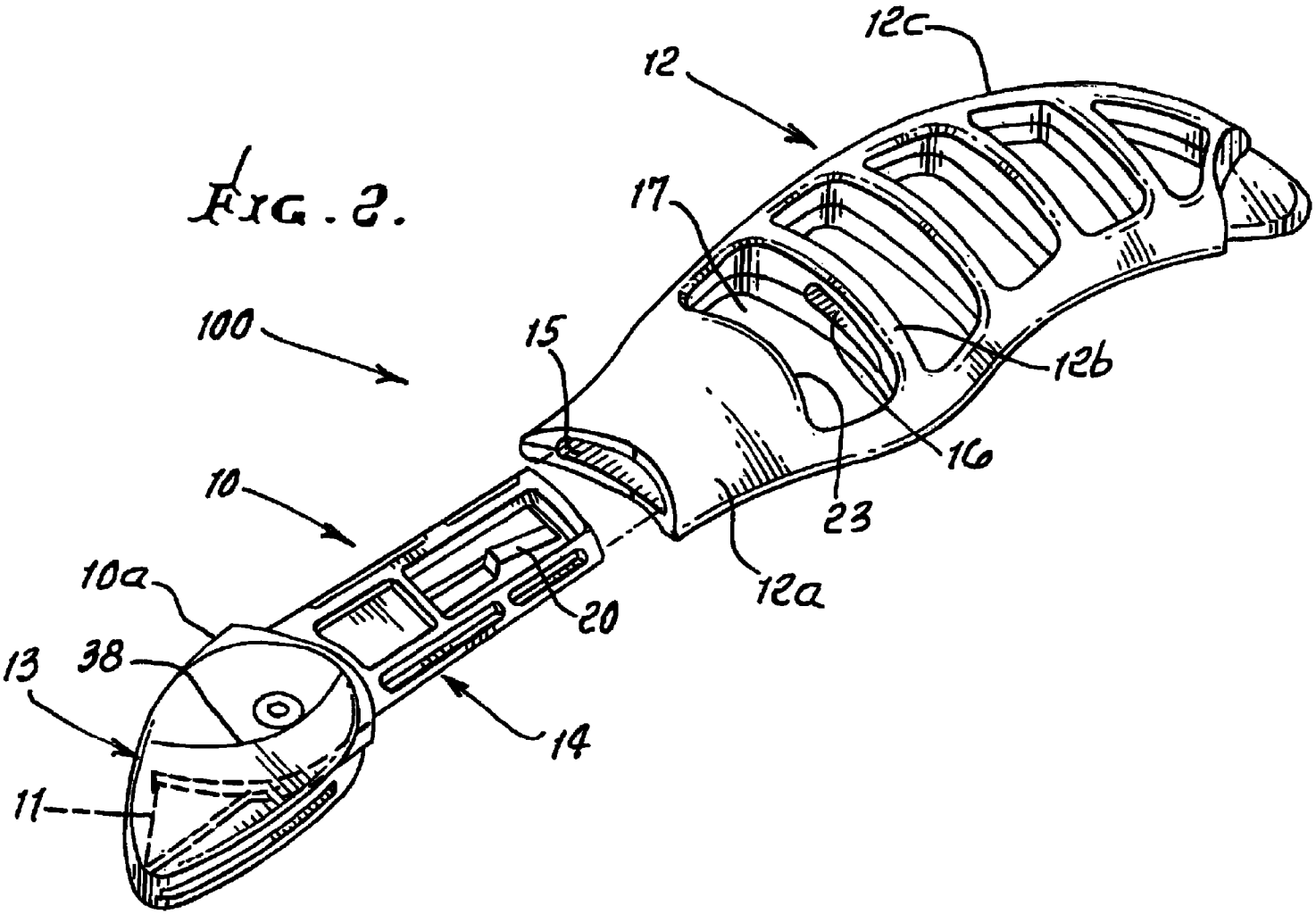
FIG. 2 is a view like FIG. 1, but showing a cartridge released from a knife handle.
Figure 4:
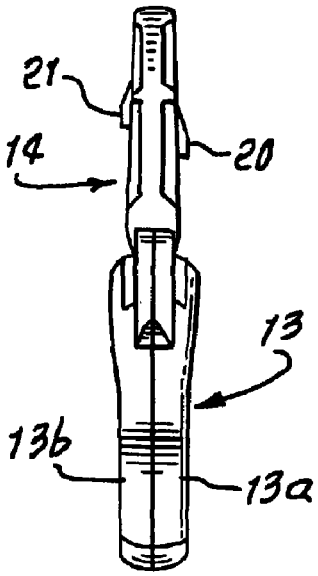
FIG. 4 is an edge view taken on lines 4-4 of FIG. 3.
Figure 3:
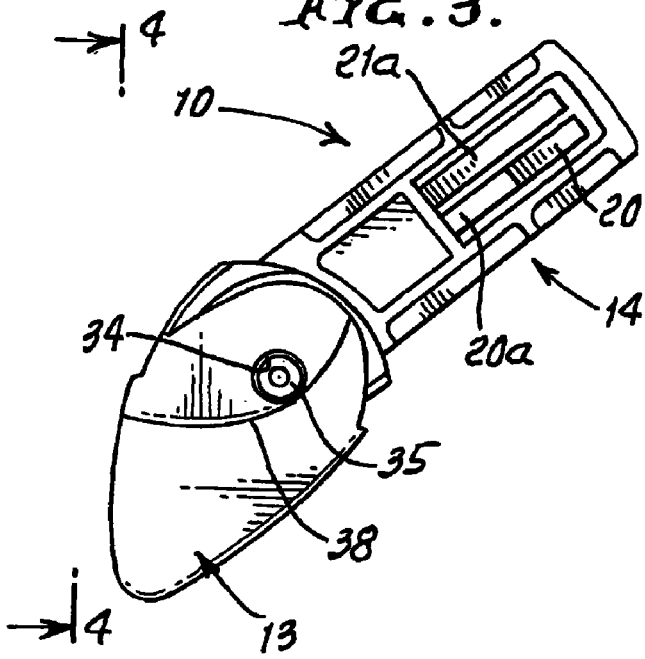
FIG. 3 is an elevation showing one side of the cartridge, with a blade shield in closed position.
Figure 5:
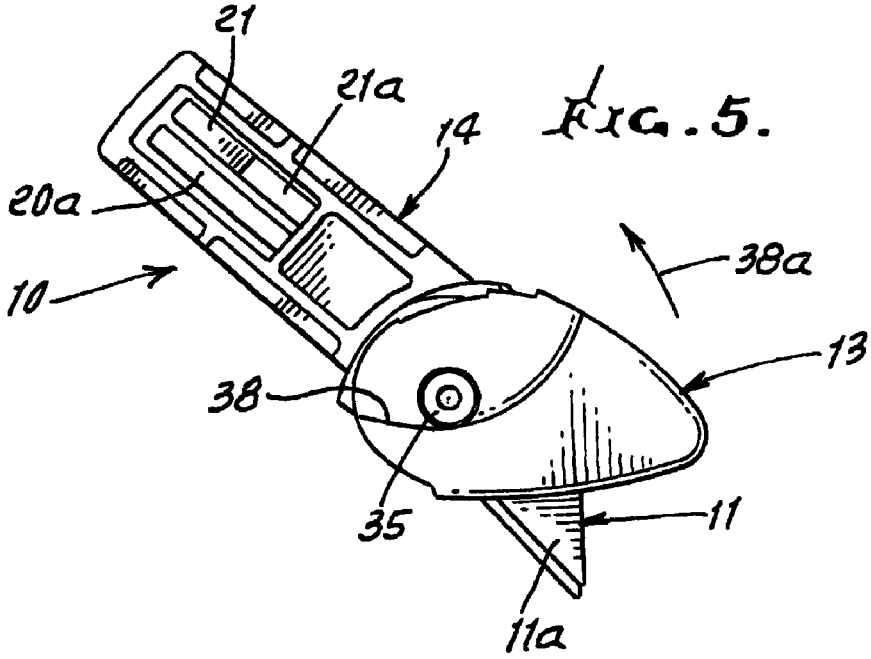
FIG. 5 is an elevation showing the opposite side of the cartridge, with the blade shield in open position, to expose the blade.
Figure 6:
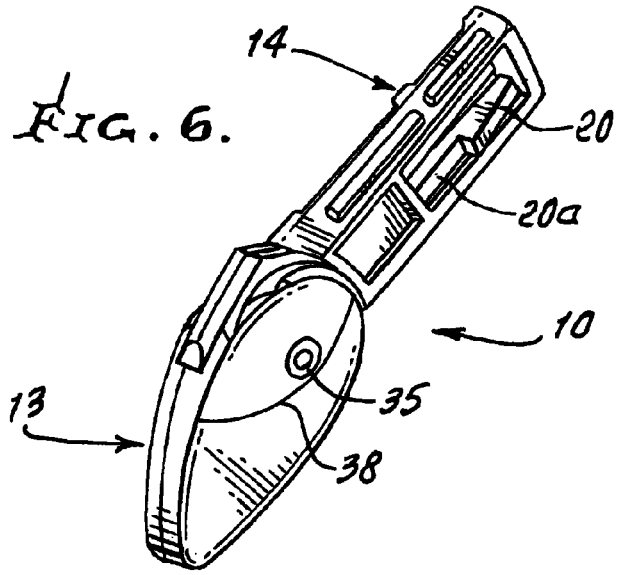
FIG. 6 is a perspective view of the cartridge.
Figure 8:
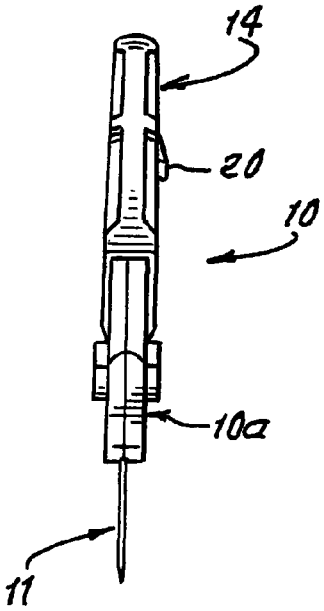
FIG. 8 is an edge view taken on lines 8-8 of FIG. 7.
Figure 7:
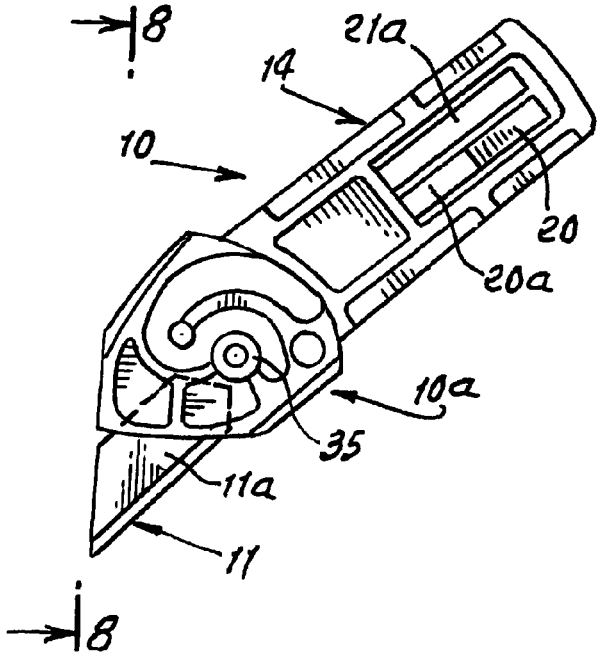
FIG. 7 is a side view in elevation like FIG. 3, but with one section of the two-section shield removed.
Figure 9:
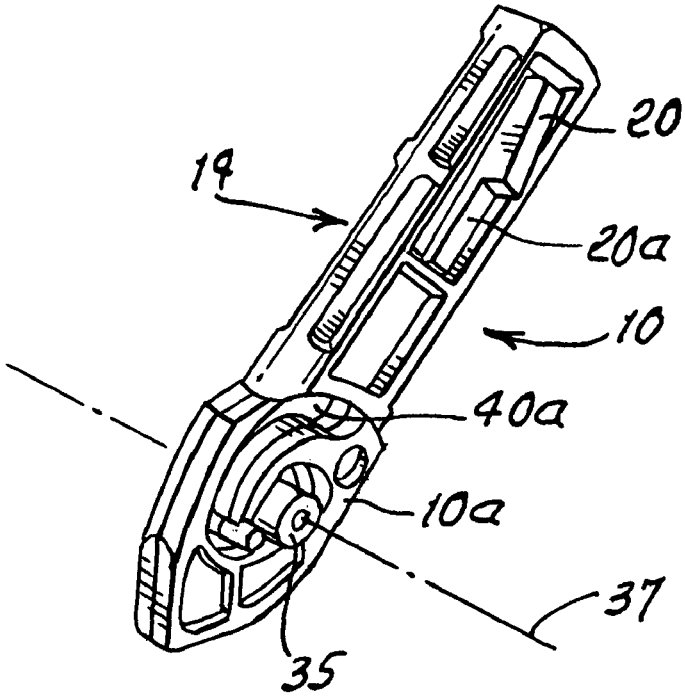
FIG. 9 is a perspective view of one side of the cartridge, with the one shield section removed, and the other shield section in place.
Figure 10:
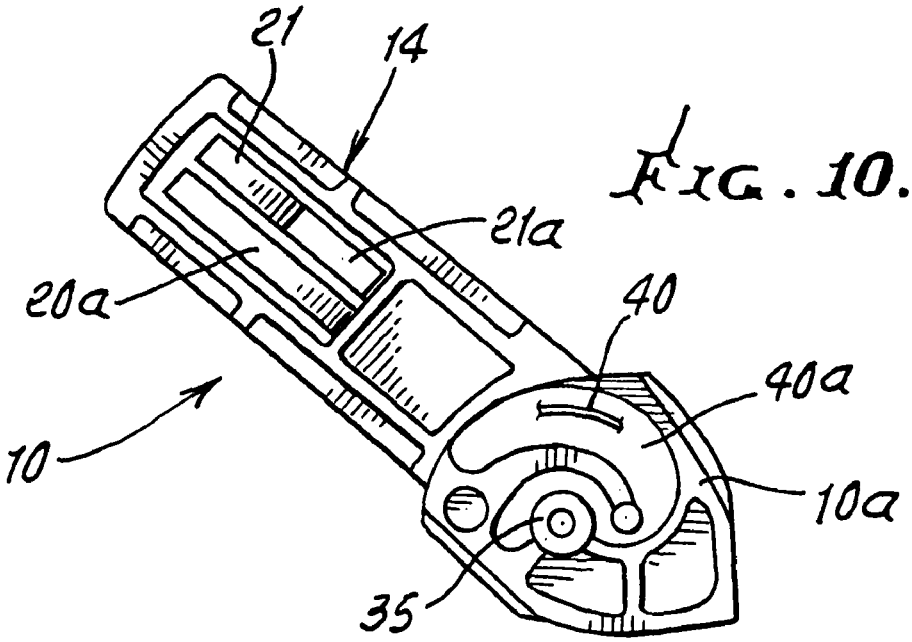
FIG. 10 is an elevation view of the opposite side of the cartridge, with the other shield section removed, and the one section in place.
Figure 12:
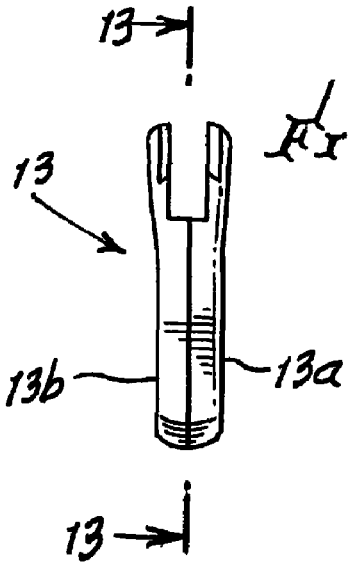
FIG. 12 is an edge view taken on lines 11-11 of FIG. 10.
Figure 11:
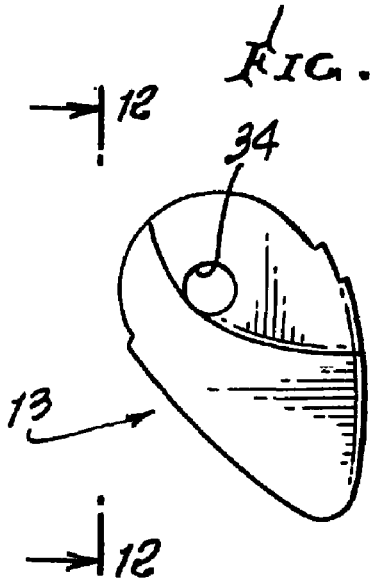
FIG. 11 is a side elevation view of the assembled shield showing one side thereof.
Figure 13:
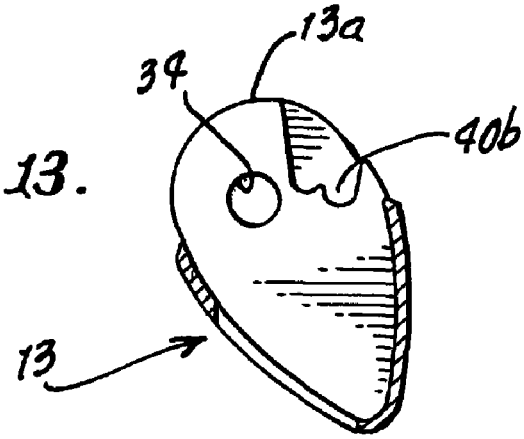
FIG. 13 is an elevation view taken on lines 13-13 of FIG. 12, showing the opposite side of the assembled shield.
Figure 14:
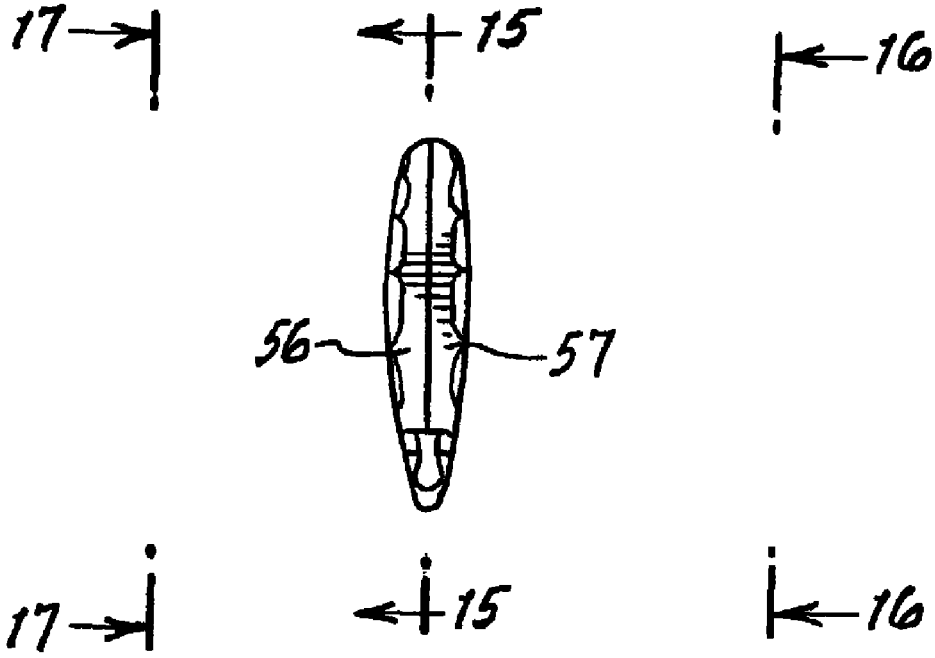
FIG. 14 is an edge view of the assembled knife handle.

Shield 13 for the blade includes opposite sections 13*a* and 13*b* (see FIG. 4) extending at opposite sides of the blade. Holes 34 carried by the sections 13*a* and 13*b* interfit post 35 formed on the intermediate cartridge body 10*a*. The post 35 defines a lateral axis 37 (see FIG. 9), about which the shield is rotatable between positions as seen in FIGS. 3 and 4. User's finger application to a concave shoulder 38 on the shield acts to effect such rotation, (see arrow 38*a* in FIG. 5), which exposes the blade forward end portion for cutting. A curved spring 40 carried in groove 40*a* body portion 10*a* (see FIG. 10) yieldably urges the shield toward FIG. 3 position, the spring being tensioned as the shield is rotated toward FIG. 5 open position. The spring has anchor ends retained at 40*b* in body 10*a* and at 40*b* in the shield (see FIG. 13).

Finally, the blade cartridge can be made highly visible, for safety by providing at with external coloring or colors. This enhances cartridge and blade discernment, for easy retrieval to avoid contaminating surroundings.

FIG. 22 is like FIG. 21, but shows a curved tool or blade edge 33*a*.

I claim:

1. A utility tool comprising:

a replaceable tool cartridge having a blade, a rotatable blade shield, a return spring that urges the shield toward a closed position, and projecting stem, where the stem includes catches; and a handle having a slot configured to receive the stem, and the handle configured to have top and bottom edges extending along the length of the handle and first and second sides;

the handle further comprising a first side through opening forming a hole extending through the first and second sides of the handle, wherein the hole is defined by the top and bottom edges, a shoulder portion and a rib, the shoulder portion and rib extending transversely between the top and bottom edges of the handle, and wherein the rib separates the first side through opening from a second side through opening in the handle; and wherein upon insertion of the stem into the slot the catches releasably attach on opposite sides of the handle to the shoulder portion extending transversely between the top and bottom edges of the handle of the first side through opening.

2. The utility tool of claim 1, wherein the blade is at an opposite end of the cartridge from the stem.

3. The utility tool of claim 1, wherein the blade comprises a curved edge.

4. The utility tool of claim 1, wherein the return spring is curved.

5. The utility tool of claim 1, wherein the handle tapers rearwardly from a stem receiving end of the handle.

6. The utility tool of claim 1, wherein the handle is curved.

7. The utility tool of claim 1, wherein the handle comprises multiple side through openings defined by additional ribs.

* * * * *